United States Patent [19]

Ashford et al.

[11] 4,373,916

[45] Feb. 15, 1983

[54] WEAPON EFFECT SIMULATORS

[75] Inventors: David W. Ashford; Robert Hummel-Newell, both of Farnborough, England

[73] Assignee: The Solartron Electronic Group Limited, Farnborough, England

[21] Appl. No.: 229,602

[22] PCT Filed: May 22, 1980

[86] PCT No.: PCT/GB80/00092

§ 371 Date: Jan. 8, 1981

§ 102(e) Date: Jan. 8, 1981

[87] PCT Pub. No.: WO80/02741

PCT Pub. Date: Dec. 11, 1980

[30] Foreign Application Priority Data

May 25, 1979 [GB] United Kingdom ..... 7918367

[51] Int. Cl.[3] ..... F41G 3/26

[52] U.S. Cl. ..... 434/22; 273/310

[58] Field of Search ..... 434/22, 21; 273/310

[56] References Cited

U.S. PATENT DOCUMENTS

| | | | |
|---|---|---|---|
| 3,104,478 | 9/1963 | Strauss et al. | 434/22 |
| 3,257,741 | 6/1966 | Cameron et al. | 434/22 |
| 3,434,226 | 3/1969 | Schaller | 434/22 |
| 3,701,206 | 10/1972 | Ormiston | 434/12 |
| 3,832,791 | 9/1974 | Robertson | 434/22 |
| 3,918,714 | 11/1975 | Ceccaroni | 273/310 |
| 3,995,376 | 12/1976 | Kimble et al. | 434/22 |
| 4,054,290 | 10/1977 | Villa | 273/310 |

FOREIGN PATENT DOCUMENTS

| | | | |
|---|---|---|---|
| 1228143 | 4/1971 | United Kingdom | 434/22 |
| 1228144 | 4/1971 | United Kingdom | 434/22 |
| 1300941 | 12/1972 | United Kingdom . | |
| 1300942 | 12/1972 | United Kingdom . | |
| 1439612 | 6/1976 | United Kingdom | 434/21 |
| 1451192 | 9/1976 | United Kingdom | 434/22 |
| 1509562 | 5/1978 | United Kingdom . | |

OTHER PUBLICATIONS

"Lasers to keep GIs on target", *Electronics,* Jun. 23, 1977, pp. 96, 97.

*Primary Examiner*—William H. Grieb
*Attorney, Agent, or Firm*—Dale Gaudier

[57] ABSTRACT

In a weapon effect simulator a low peak power laser projector emits one millisecond bursts of radiation, each burst having either pulse or continuous wave modulation at 170 kHz. A detector for sensing the radiation has several photocells connected in parallel to a single amplifier, and includes a band pass filter tuned to 170 kHz (chosen in harmonic relationship to the modulation frequency) and having a pass band of 2 kHz (inversely related to the duration of each radiation burst).

6 Claims, 8 Drawing Figures

350 ns
6μs
0
1
2
3 ms kHz
-170
0
170
340
2 kHz 0
1
2
3 ms kHz
0
170

WEAPON EFFECT SIMULATORS

TECHNICAL FIELD

This invention relates to weapon effect simulators.

BACKGROUND ART

It is known to use a beam of electromagnetic radiation (typically from a laser) during simulated operation of a weapon for training purposes. In one type of system (U.K. patent specifications Nos. 1,228,143; 1,228,144; 1,439,612 and 1,451,192), the beam of radiation is pointed in the same direction as the weapon (for example, a gun) at the time of 'firing' the ammunition (a shell or bullet) with adjustment for such factors as aim-off if appropriate. In another type (U.K. patent specifications Nos. 1,300,941 and 1,300,942) the beam is pointed to intersect continuously the path that the ammunition (for example, a missile) would follow in a live firing. In either case, the result is that the beam of radiation is directed at the point in space occupied by the ammunition when it reaches the vicinity of the target.

Such systems basically involve a device, commonly known as a projector, for generating, and if necessary orienting, the beam of radiation, and another device, known as a detector, for detecting incidence of the radiation on the target. The detector may be mounted on the target itself, or it may be associated with the projector, the radiation being reflected from the target by a retro-reflector mounted thereon.

In known systems, the projector has been arranged to generate radiation in the form of pulses of very short duration and relatively high peak power. Consequently, the detector (a photo-cell coupled to an amplifier) has been designed essentially to detect each pulse of radiation as an individual, discrete entity. Because of the abrupt nature of the pulses, the bandwidth of the detector amplifier has to be relatively large to ensure reliable detection of a pulse, which in turn limits to one the number of photo-cells which can be connected to an amplifier if an acceptable signal-to-noise ratio is to be maintained. In practice, a target needs to be fitted with at least four photo-cells to ensure detection of radiation from any direction around the target, and each of these photo-cells requires its own sensitive, stable, wide-bandwidth (and therefore expensive) amplifier.

DISCLOSURE OF INVENTION

According to one aspect of this invention there is provided a weapon effect simulator having a projector arranged to project a beam of electromagnetic radiation during simulated firing of a weapon and a detector arranged to detect incidence of said radiation thereupon, wherein:

said projector is arranged to generate at least one burst of radiation for each said firing, said burst being of predetermined duration and being modulated at a predetermined frequency; and said detector includes frequency-selective means tuned to a frequency harmonically related to said predetermined frequency and having a pass band dependent upon said predetermined duration.

The radiation is detected by detection of the overall burst and its modulation (which can, for example, be pulse modulation or continuous-wave modulation), rather than by separate detection of individual pulses (in the case of pulse modulation). The frequency-selective means is conveniently tuned to said predetermined frequency.

The pass band of the frequency-selective means may be substantially equal to twice the reciprocal of said predetermined duration. By making this duration relatively long (for example, one millisecond), the pass band can be made very narrow (only 2 kHz), thereby diminishing noise considerably, to the extent that several photo-cells can be coupled in parallel. Furthermore the peak power that must be radiated for a given signal-to-noise ratio is substantially reduced, permitting the use, for example, of low peak power, higher mean power devices such as double heterostructure lasers and small source light emitting diodes.

BRIEF DESCRIPTION OF DRAWINGS

A weapon effect simulator in accordance with this invention will now be described, by way of example, with reference to the accompanying drawings, in which.

FIGS. *5a, 5b* and *6a, 6b* are waveform and spectral diagrams illustrating pulse modulation and continuous-wave modulation respectively.

BEST MODE FOR CARRYING OUT THE INVENTION/INDUSTRIAL APPLICABILITY

Figure 1:
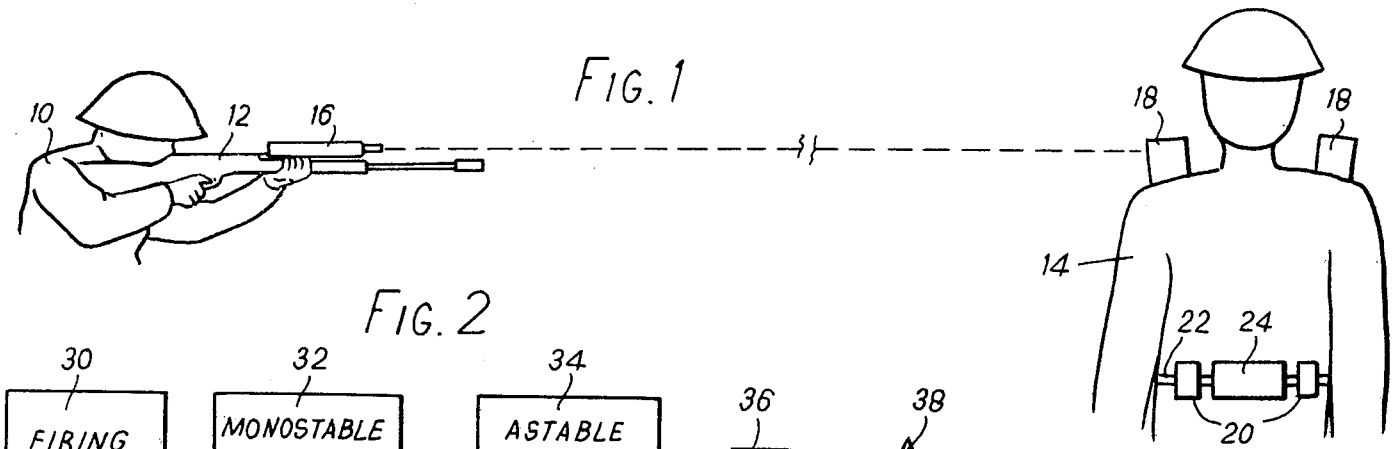
FIG. 1 depicts an attacking soldier and a target soldier.

Referring to FIG. 1, an attacking soldier 10 under training is aiming a rifle 12 at a target soldier 14. The rifle 12 is loaded with blank ammunition and carries a laser projector 16. The target soldier 14 has two detectors 18 on his shoulders and four more detectors 20 on a belt 22 about his waist. All the detectors 18 and 20 are connected to a control unit and smoke generator 24 also carried on the belt 22.

When the soldier 10 pulls the trigger of the rifle 12, the blank ammunition is fired, giving appropriate aural and visual effects. At the same time, the laser projector 16 is automatically operated to project a beam of electromagnetic radiation along the direction of aim of the rifle 12. If rifle 12 has been accurately aimed at the soldier 14, the radiation will strike the detectors 18 and/or 20, causing a signal to be sent to the control unit 24 which thereupon releases smoke to indicate that the target soldier 14 has been 'hit'. If the target soldier 14 has a rifle, this can be coupled to the control unit 24 to be inhibited from 'firing' in the event of a 'hit'.

The design and operation of the projector 16 and the control unit 24 will now be described in more detail with reference to FIGS. 2 to 6.

Figure 2:
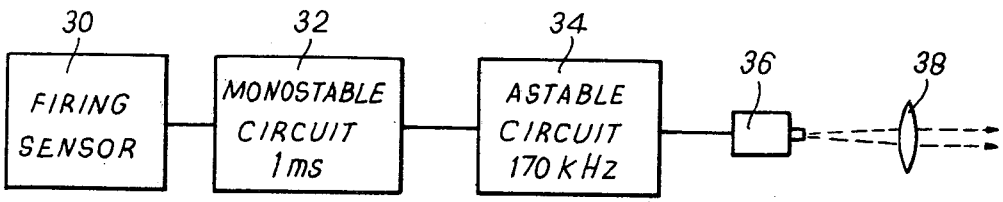
FIG. 2 is a block schematic diagram of one form of projector.

Referring to FIG. 2, the firing of the rifle 12 is detected by a firing sensor 30, which may be, for example, a microphone and amplifier to detect the sound of the rifle 12 being fired, or a pressure-responsive switch operated by the back pressure in the rifle barrel when the blank ammunition is fired. The sensor 30 triggers a monostable circuit 32 which supplies a pulse of 1 millisecond duration to enable an astable circuit 34. This astable circuit 34 supplies pulses at a repetition frequency of 170 kHz to a gallium arsenide double-heterostructure laser device 36, to generate pulses of infra-red radiation at a rate of 170 kHz for 1 millsecond. A lens 38 in front of the laser device 36 focusses the radiation into a beam.

In the projector illustrated in FIG. 2, only a single burst of pulses of radiation is emitted each time the rifle 12 is fired. However, if desired, several bursts may be emitted for each firing, using the circuit shown in FIG. 3.

Figure 3:
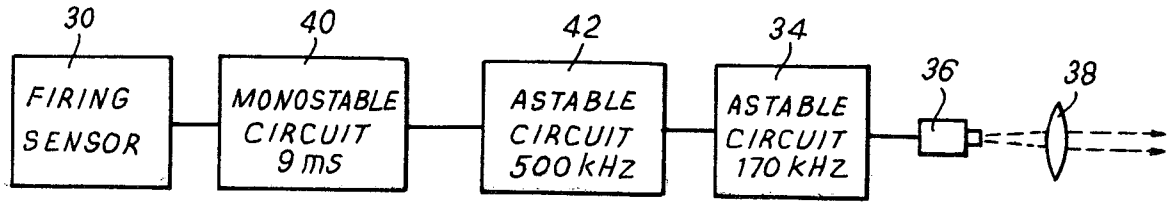
FIG. 3 is a block schematic diagram of another form of projector.

Referring to FIG. 3, the firing sensor 30 is coupled to the astable circuit 34 via a monostable circuit 40 and a second astable circuit 42. The monostable circuit 40, when triggered, supplies a pulse having a duration of 9 milliseconds, thereby enabling the astable circuit 42 which runs at a frequency of 500 Hz. Thus the astable circuit 34 is in turn enabled for five periods each 1 millisecond in duration and spaced 1 millisecond apart, and the laser device 36 emits five corresponding bursts of 170 kHz pulses of infra-red radiation.

Figure 4:
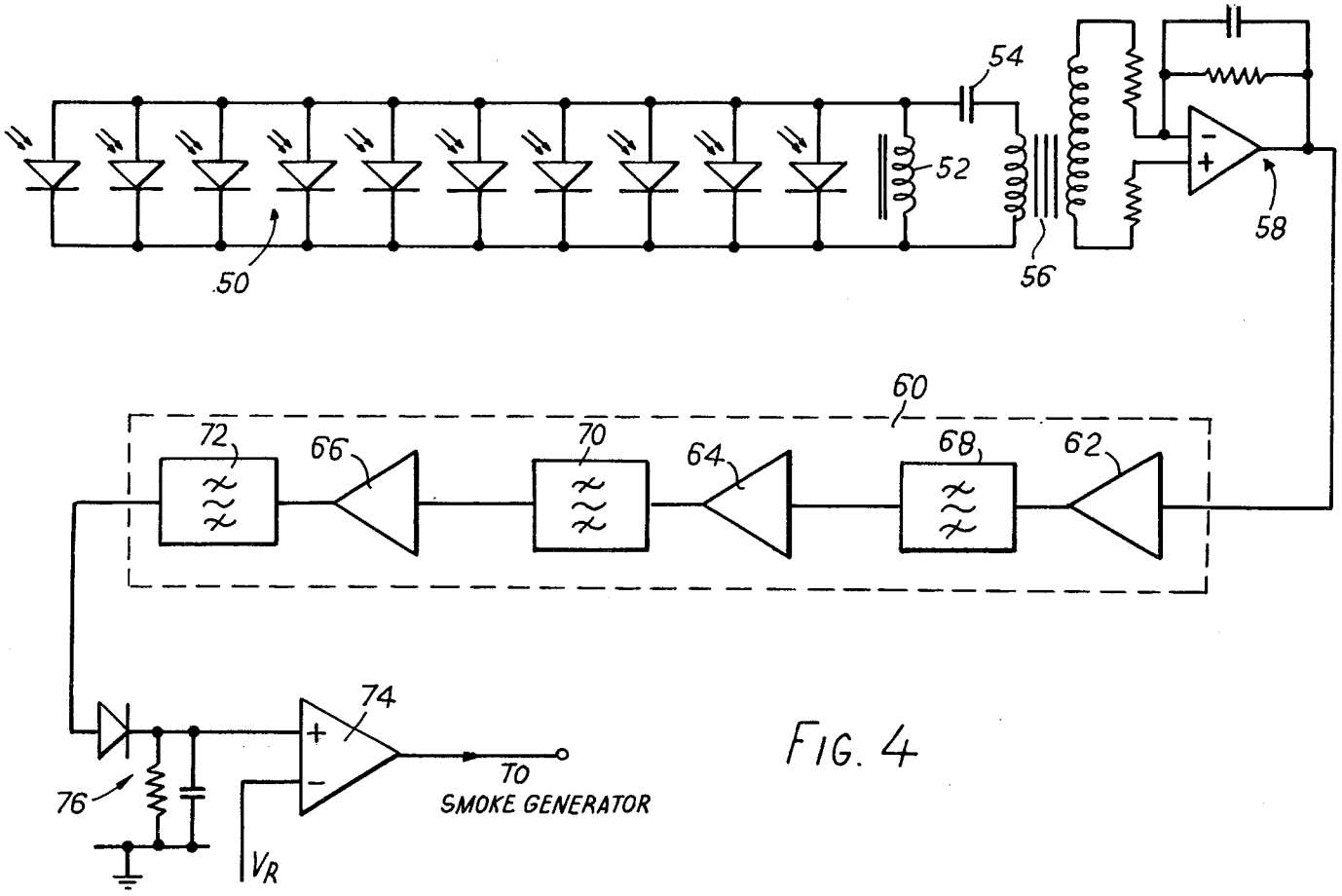
FIG. 4 is a circuit diagram of a detector.

Referring now to FIG. 4, the detectors 18, 20 are represented by ten unbiassed photo-sensitive silicon cells 50 connected in parallel with each other and with a choke 52. The choke 52 provides a d.c. leakage path for charge induced in the cells 50 by ambient light, thereby preventing such charges from accumulating and saturating the cells 50. High-frequency signals, which are not affected by the choke 52, are coupled by a capacitor 54 to a primary winding of a coupling transformer 56. The turns ratio of this transformer 56 is selected for optimum signal-to-noise ratio, and the secondary winding of the transformer feeds a low-noise amplifier 58 of conventional design, having a low-value feedback capacitor to limit its high-frequency response.

The output of the amplifier 58 is coupled to a three-stage bandpass filter 60, each stage of which comprises an amplifier 62, 64, 66 and an associated parallel-resonant bandpass LC filter 68, 70, 72 tuned to 170 kHz and having a passband of 2 kHz. The filtered signal is then supplied to a comparator 74, which controls the smoke generator, via a diode detector-demodulator 76.

In use, pulses of infra-red radiation incident upon any of the detectors 18, 20 (that is, on any of the photo-cells 50) cause corresponding electrical pulses to be supplied via the capacitor 54 and the transformer 56 to the amplifier 58. After amplification, the 1 millisecond bursts of 170 kHz pulses are selectively passed by the filter 60 to the comparator 74 which actuates the smoke generator if the amplitude of the filtered signal exceeds a threshold voltage $V_R$.

Figures 5A, 5B, 6A, 6B:
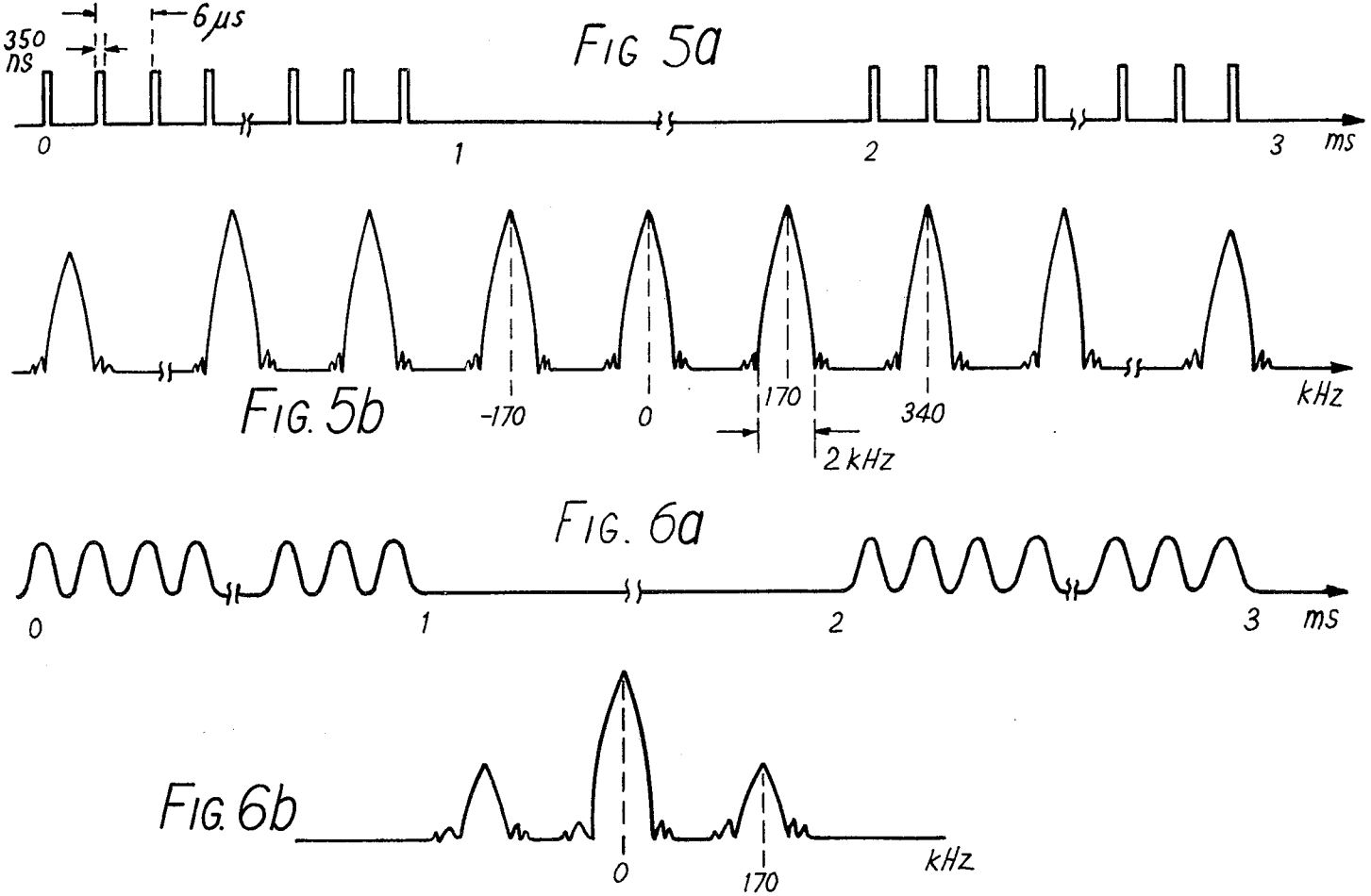

FIG. 5 (*a*) shows the waveform of typical bursts of infra-red radiation, each comprising pulses 350 nanoseconds long repeated at intervals of 6 microseconds for a period of 1 millisecond. The frequency-domain equivalent of this waveform is shown in FIG. 5 (*b*), and comprises an main lobe centred on 0 Hz and additional lobes centred on integral multiples of 170 kHz, each lobe embracing a frequency range of 2 kHz.

The effect of the filter 60 is to select the lobes centred on +170 kHz and −170 kHz (where the negative sign indictes a signal in anti-phase to one having a positive sign). The 2 kHz passband of the filter 60 is related to the 2 kHz range of the lobes in the frequency spectrum of the pulse bursts, and this range is in turn determined (on an inverse basis) by the 1 millisecond duration of each burst. The operation of the filter can thus be considered as being the integration of all the pulses of a burst for the duration of the burst, so the energy associated with each individual pulse is aggregated with that of all the other pulses in the burst. Consequently, a laser device which is capable of relatively high mean power but relatively low peak power, such as the (relatively cheap) double heterostructure device mentioned previously, can be used in the projector 16. This in turn confers advantages in terms of stability of operation of the projector with change in temperature, and permits the use of small, low-voltage drive transistors with the laser device. The relatively narrow (2 kHz) bandwidth of the filter 60 also significantly limits the proportion of the noise signal from the photo-cells 50 which can reach the comparator 74, thereby facilitating the use of a low peak power laser device and permitting the parallel connection of several photo-cells 50 to a single amplifier 58 as shown in FIG. 4.

Using the bandpass filter 60 tuned to 170 kHz instead of a low pass filter (to detect the main lobe centred on 0 Hz—FIG. 5(*b*), avoids spurious output signals arising either from sudden changes in ambient light or from artificial light sources to which the apparatus may be exposed during fitting and setting up. The bandpass filter 60 could be tuned to a harmonic of the pulse repetition frequency (such as 340 kHz) rather than to the repetition frequency of 170 kHz itself. Furthermore, the frequency selection could be performed before the coupling transformer 56, by selecting the inductance of the choke 52 to resonate with the combined self-capacitance of the photo-cells 50 at the desired bandpass frequency.

Instead of pulse modulation of the radiation emitted by the projector 16, it is also possible to use continuous-wave modulation, as illustrated in FIG. 6 (*a*). In this case, the astable circuit 34 of FIGS. 2 and 3 would be replaced by a suitable sine-wave oscillator. FIG. 6 (*b*) shows the frequency spectrum of this type of modulation, for which the bandpass filter 60 would be tuned to the modulation frequency (170 kHz) of the 1-millisecond bursts of radiation. With c.w. modulation, for which a striped-geometry type of laser or small source light emitting diode is particularly suitable, rather more of the modulation power (up to half) can be extracted by the filter 60 than is the case with pulse modulation.

The LC filter 60 could be replaced by other circuitry having the same function, such as a CCD recirculating shift register clocked at 170 kHz and having a loop gain chosen to provide the desired 2 kHz passband.

Various other modifications can be made to the described embodiment of the invention. For example, in another embodiment of the invention, the operating frequency of the astable circuit of FIG. 3 was changed from 170 kHz to 113 kHz, and the duration of the pulse produced by the monostable circuit 40 was reduced so that the laser device 36 produced two 1 millisecond bursts of 113 kHz pulses of infra-red radiation for each firing of the rifle 12. The detector circuitry of FIG. 4 was also modified, by (i) tuning each stage of the bandpass filter 60 to the fourth harmonic of the laser p.r.f, that is to 452 kHz, (ii) correspondingly increasing the upper cut off frequency of the amplifier 58, and (iii) connecting a further bandpass filter, tuned to 470 kHz, to the output of the amplifier 58: both bandpass filters used ceramic filter elements. The output of this further filter was applied, via a diode detector-demodulator identical to that shown at 76 in FIG. 4 and a x3 amplifier, to the inverting input of the comparator 74 (i.e. as the voltage $V_R$). The output of the comparator 74 was then connected to a double-pulse detector, ie a detector which detects the occurrence of two consecutive pulses within a predetermined time period, eg 1½ milliseconds. In operation of this embodiment, wide-band or impulsive noise tended to produce substantially equal outputs from both the diode detector-demodulators, so the comparator 74 was not triggered by such noise and spurious triggering of the double-pulse detector was prevented. In fact, the x3 amplifier ensures that the comparator 74 can be triggered only when the signal appearing at the output of the diode detector-demodulator 76 exceeds that at the output of the other diode-demodulator by more than a factor of three.

If desired, a further comparator similar to the comparator 74, but triggered by pulses of lower amplitude (or lower relative amplitude) from the diode detector-demodulator 76, can be provided, in order to permit a distinction to be made between a "hit" (comparator 74 triggered) and a "near miss" (further comparator triggered, but comparator 74 not triggered).

The use of the relatively low-powered laser device 36, and the use of the unbiassed detectors 18, 20 connected in parallel to the single low-noise amplifier 58, each help to significantly reduce the power consumption of their respective parts of the simulator, which, since these parts are normally battery-powered, is very important.

We claim:

1. A weapon effect simulator having a projector arranged to project a beam of electromagnetic radiation during simulated firing of a weapon and a detector arranged to detect incidence of said radiation thereupon, characterised in that:

aid projector is arranged to generate at least one burst of radiation for each said firing, said burst being of predetermined duration and being modulated at a predetermined frequency;

and in that said detector includes frequency-selective means tuned to a frequency harmonically related to said predetermined frequency and having a pass band dependent upon said predetermined duration.

2. A simulator according to claim 1, wherein said modulation is pulse modulation.

3. A simulator according to claim 1, wherein said modulation is continuous-wave modulation.

4. A simulator according to claim 1, wherein said frequency-selective means is tuned to said predetermined frequency.

5. A simulator according to claim 1, wherein said pass band is substantially equal to twice the reciprocal of said predetermined duration.

6. A simulator according to claim 1, wherein said detector has a plurality of light-sensitive cells coupled in parallel to a single amplifier.

* * * * *